US012716329B2

(12) United States Patent
McDaniel et al.

(10) Patent No.: US 12,716,329 B2
(45) Date of Patent: Aug. 25, 2026

(54) HYDRAULIC ACTUATED TOOL CATCHER

(71) Applicant: SCHLUMBERGER TECHNOLOGY CORPORATION, Sugar Land, TX (US)

(72) Inventors: Ian McDaniel, Katy, TX (US); Jesse Garcia, Houston, TX (US); Kody Carrillo, Cypress, TX (US); Pandeeswaran Krishnasamy, Coimbatore (IN)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/122,158

(22) PCT Filed: Oct. 13, 2023

(86) PCT No.: PCT/US2023/035137

§ 371 (c)(1),
(2) Date: Apr. 17, 2025

(87) PCT Pub. No.: WO2024/086075

PCT Pub. Date: Apr. 25, 2024

(65) Prior Publication Data

US 2026/0153012 A1 Jun. 4, 2026

(30) Foreign Application Priority Data

Oct. 18, 2022 (IN) ..... 202241059381

(51) Int. Cl.
*E21B 40/00* (2006.01)
*E21B 23/14* (2006.01)

(52) U.S. Cl.
CPC ..... *E21B 40/00* (2013.01); *E21B 23/14* (2013.01)

(58) Field of Classification Search
CPC ..... E21B 40/00; E21B 23/14
See application file for complete search history.

(56) References Cited

U.S. PATENT DOCUMENTS 4,577,687 A * 3/1986 Lanmon, II ..... E21B 33/072 166/243
4,899,816 A 2/1990 Mine
(Continued)

FOREIGN PATENT DOCUMENTS

WO 2015198041 A3 3/2016

OTHER PUBLICATIONS

"Hunting EziCatch® Tool Catcher", Hunting, Retrieved from the internet: https://cdn.sanity.io/files/bwa44qrg/production/b4996951fcde8b1f59d18abd83a4530eff00c96d.pdf, Retrieved date—Jan. 27, 2026, 1 Page.

(Continued)

*Primary Examiner* — James G Sayre
(74) *Attorney, Agent, or Firm* — Jeffrey D. Frantz

(57) ABSTRACT

A tool catcher system includes a housing including an upper body connected to a lower body, the housing defining a central opening for receiving a tool. The tool catcher system also includes a plurality of segments and a hydraulic piston disposed between the upper body and the lower body. The hydraulic piston engages the plurality of segments, and a spring plate couples to and moves with the plurality of segments, which is configured to move between a closed position for catching the tool, and an open position for releasing the tool. The tool catcher system also includes a first spring that biases the spring plate in a first direction to catch the tool, and a second spring abutting against the hydraulic piston. The hydraulic piston is configured to move (Continued)

the plurality of segments and compress the second spring in a second direction opposite the first direction to release the tool.

17 Claims, 8 Drawing Sheets

(56) References Cited

U.S. PATENT DOCUMENTS

| | | | | |
|---|---|---|---|---|
| 6,196,325 | B1 * | 3/2001 | Connell | E21B 17/041 166/242.6 |
| 7,934,548 | B2 | 5/2011 | Doud | |
| 10,208,557 | B2 | 2/2019 | Keller | |
| 11,162,318 | B2 | 11/2021 | McDaniel | |
| 2012/0043089 | A1 | 2/2012 | Hoffman | |
| 2012/0193104 | A1 | 8/2012 | Hoffman | |
| 2019/0383113 | A1 * | 12/2019 | McDaniel | E21B 33/03 |
| 2021/0079751 | A1 * | 3/2021 | McDaniel | E21B 33/0407 |

OTHER PUBLICATIONS

"Hydraulic Wireline Tool Catcher", NOV., Retrieved from the internet: https://www.nov.com/products/hydraulic-wireline-tool-catcher, 2026, 7 Pages.

* cited by examiner

HYDRAULIC ACTUATED TOOL CATCHER

CROSS-REFERENCE TO RELATED APPLICATION

This application is a national stage entry of PCT Application No. PCT/US2023/035137, filed Oct. 13, 2023, which claims priority to India Provisional Patent Application No. 20/224,1059381, which was filed on Oct. 18, 2022.

BACKGROUND

Well intervention is any operation carried out on an oil and gas well to extend its producing life by improving performance, provide data to help manage the production rate of the well, shut off and safely abandon a flowing well, provide maintenance, or repair or replace downhole equipment. During wireline operations, a pressure control equipment ("PCE") stack is mounted above a wellhead to protect other surface equipment from surges in pressure within a wellbore or to carry out other supportive functions. In a typical wireline operation, a metal cable or wireline is used to suspend and control various tools that are to be deployed within a wellbore. The PCE stack may include a tool catcher, which is used while deploying the tool into the wellbore, or while the tool is pulled from the wellbore. When the tool is pulled up in the wellbore, and if the wireline breaks due to excessive force, the tool catcher operates to catch the separated tool to prevent its loss downhole. There is a need for improved, affordable, and light-weight tool catchers that can accommodate a variety of tool head sizes to facilitate wireline intervention operations.

SUMMARY

According to one or more embodiments of the present disclosure, a tool catcher system includes a housing including an upper body connected to a lower body, wherein the housing defines a central opening that is configured to receive a tool; a plurality of segments disposed between the upper body and the lower body, wherein the plurality of segments is configured to move between a closed position in which the plurality of segments catches the tool, and an open position in which the plurality of segments releases the tool; a spring plate that couples to and moves with the plurality of segments; a hydraulic piston disposed between the upper body and the lower body, wherein the hydraulic piston engages the plurality of segments; a first spring that biases the spring plate in a first direction to catch the tool; and a second spring abutting against the hydraulic piston, wherein the hydraulic piston is configured to move the plurality of segments and compress the second spring in a second direction opposite the first direction to release the tool.

A method according to one or more embodiments of the present disclosure includes pulling a tool in an upward direction into a central opening of a tool catcher system using a cable, the tool catcher system including: a housing including an upper body connected to a lower body, wherein the housing defines the central opening for receipt of the tool; a plurality of ring segments including a plurality of angled surfaces, the plurality of ring segments being disposed between the upper body and the lower body; a spring plate that couples to and moves with the plurality of ring segments; a hydraulic piston disposed between the upper body and the lower body, wherein the hydraulic piston engages the plurality of segments; a first spring that biases the spring plate in a downward direction to catch the tool; and a second spring abutting against the hydraulic piston, wherein the tool includes a tool head having an angled surface, and a next portion beneath the angled surface; contacting the plurality of ring segments with the tool head; engaging the plurality of angled surfaces of the plurality of ring segments with the angled surface of the tool head, thereby driving the plurality of ring segments in a radially outward direction, and driving the spring plate in an upward direction, compressing the first spring; pulling the angled surface of the tool head past the plurality of angled surfaces of the plurality of ring segments, causing the first spring to drive the spring plate in the downward direction, thereby driving the plurality of ring segments in a radially inward direction; and contacting the plurality of ring segments with the next portion of the tool head, thereby catching the tool and preventing movement of the tool in the downward direction.

According to one or more embodiments of the present disclosure, a tool catcher system includes a housing including an upper body connected to a lower body, wherein the housing defines a central opening that is configured to receive a tool; a plurality of segments disposed between the upper body and the lower body, wherein the plurality of segments is configured to move between a closed position in which the plurality of segments catches the tool, and an open position in which the plurality of segments releases the tool; a spring plate that couples to and moves with the plurality of segments; a hydraulic piston disposed between the upper body and the lower body, wherein the hydraulic piston engages the plurality of segments; a spring that biases the spring plate in a first direction to catch the tool; and a seal disposed between the upper body and the lower body of the housing, wherein the hydraulic piston is configured to move the plurality of segments, which pushes the spring plate in a second direction opposite the first direction to release the tool, and to move the spring plate in the first direction to catch the tool.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

It will also be understood that, although the terms first, second, etc. may be used herein to describe various elements, these elements should not be limited by these terms. These terms are only used to distinguish one element from another. For example, a first object could be termed a second object, and, similarly, a second object could be termed a first object, without departing from the scope of the present disclosure.

In general, embodiments of the present disclosure relate to wireline PCE systems and methods. Wireline PCE stacks are coupled to and/or positioned vertically above a wellhead during wireline operations in which a tool supported on a wireline is lowered through the wireline PCE stack to enable inspection and/or maintenance of a well, for example. The wireline PCE stack includes components that seal about the wireline or cable as it moves relative to the wireline PCE stack. The wireline PCE stack may isolate the environment, as well as other surface equipment, from pressurized fluid within the well. That is, the PCE employed during wireline operations is intended to contain pressure originating from the wellbore.

Figure 1:
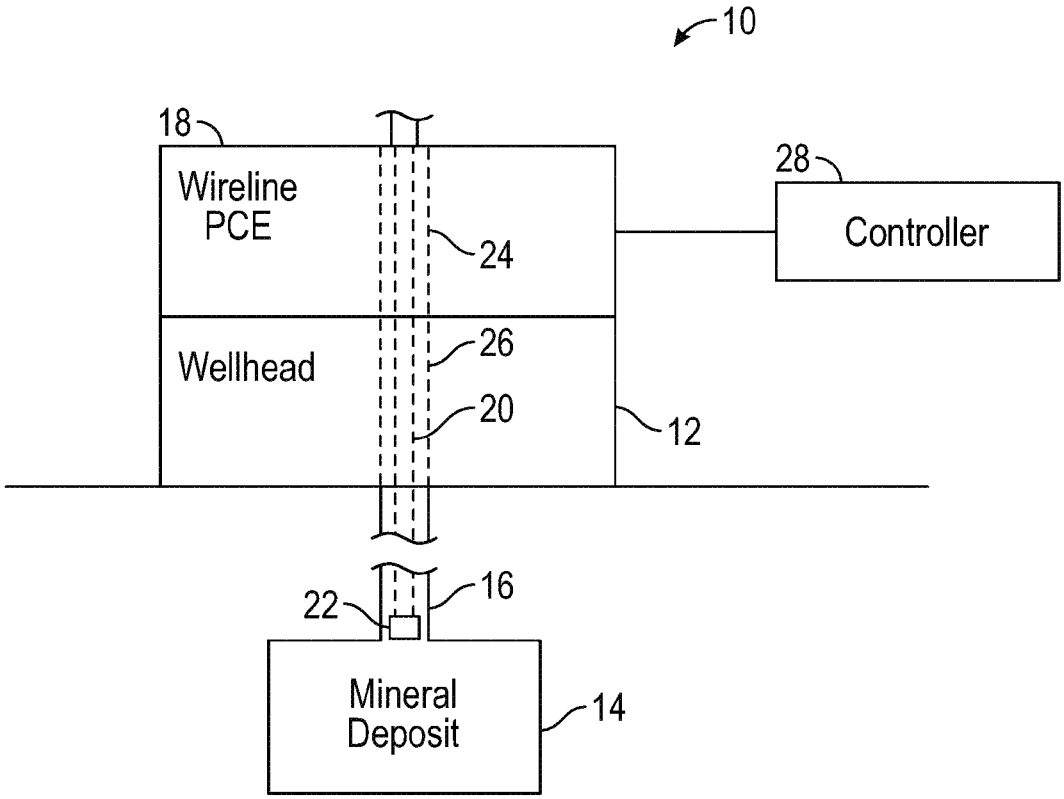
FIG. 1 shows a schematic diagram of a wireline intervention system, according to one or more embodiments of the present disclosure.

Referring now to FIG. 1, a schematic diagram of a wireline intervention system 10 according to one or more embodiments of the present disclosure is shown. The system 10 includes a wellhead 12, which is coupled to a mineral deposit 14 via a wellbore 16. The wellhead 12 may include any of a variety of other components such as a spool, a hanger, and a Christmas tree. According to one or more embodiments of the present disclosure, FIG. 1 shows a wireline PCE stack 18 coupled to the wellhead 12 to facilitate wireline operations, which are carried out by lowering a cable 20 (e.g., communication cable, wireline, slickline, or coiled tubing) and a tool 22 (e.g., logging tools, perforating guns, plugging tools, etc.) through a bore 24 defined by the wireline PCE stack 18, through a bore 26 defined by the wellhead 12, and into the wellbore 16. As shown, a controller 28 (e.g., an electronic controller) may be provided to control one or more components of the wireline PCE stack 18 via an electric actuator, for example.

Figure 2:
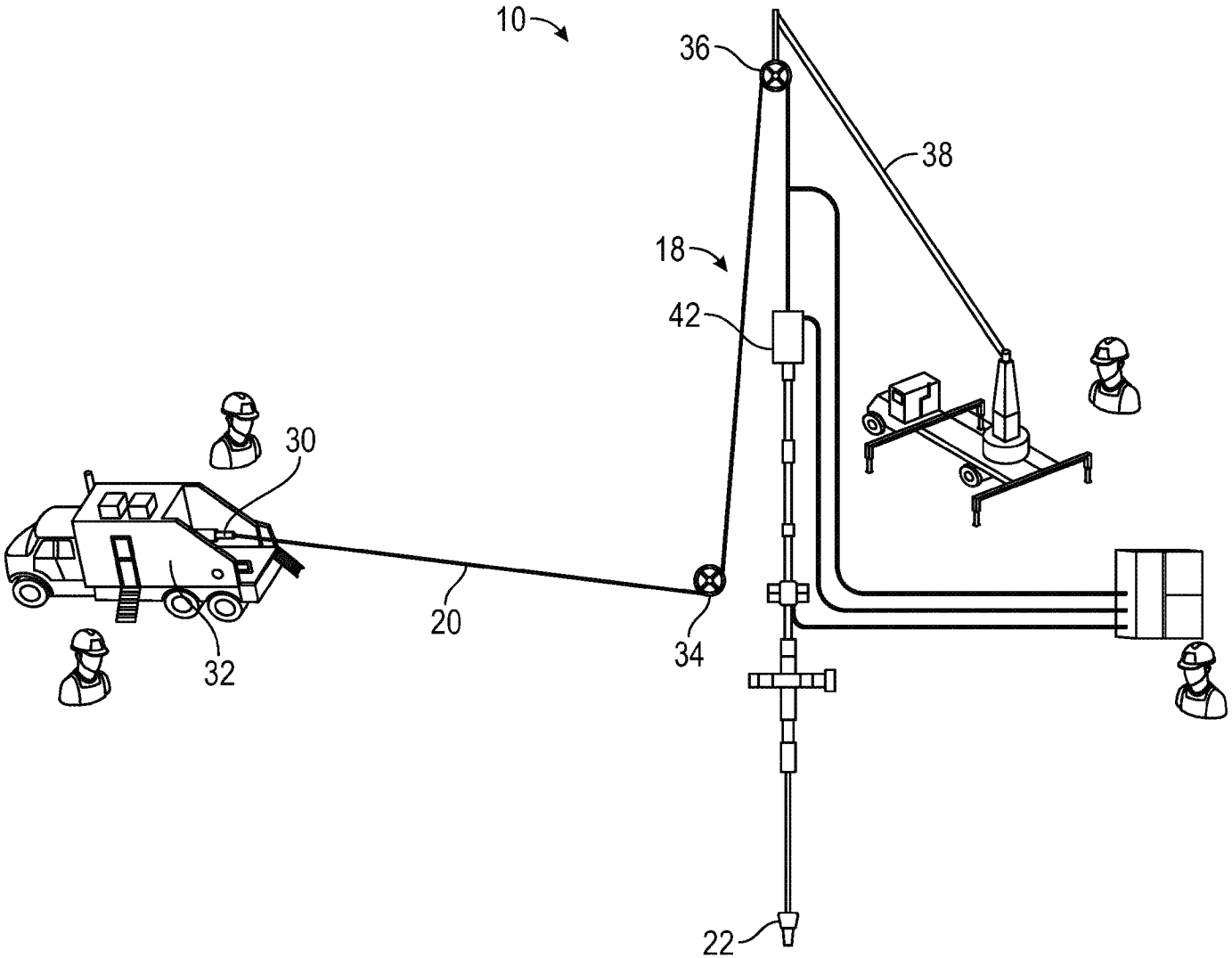
FIG. 2 shows an illustration of a wireline intervention operation, according to one or more embodiments of the present disclosure.

Referring now to FIG. 2, an illustration of a wireline intervention operation according to one or more embodiments of the present disclosure is shown. Specifically, FIG. 2 shows a winch or drum 30 located external to the wireline intervention system 10 according to one or more embodiments of the present disclosure. As shown in FIG. 2, for example, the drum 30 may be mounted on a vehicle or other surface equipment 32, according to one or more embodiments of the present disclosure. Cable 20 may be wrapped around drum 30 to facilitate raising and lowering of tool 22 during a wireline intervention operation according to one or more embodiments of the present disclosure. For example, as shown in FIG. 2, the cable 20 may be routed from the drum 30 to a lower sheave 34 and then up to an upper sheave 36, which may be hung from a mast 38 or the like. From the upper sheave 36, the cable 20 may be routed into the wireline PCE stack 18, according to one or more embodiments of the present disclosure. As shown in FIG. 2, the PCE stack 18 may include a tool catcher system 42, the particulars of which are further described below.

Figure 3:
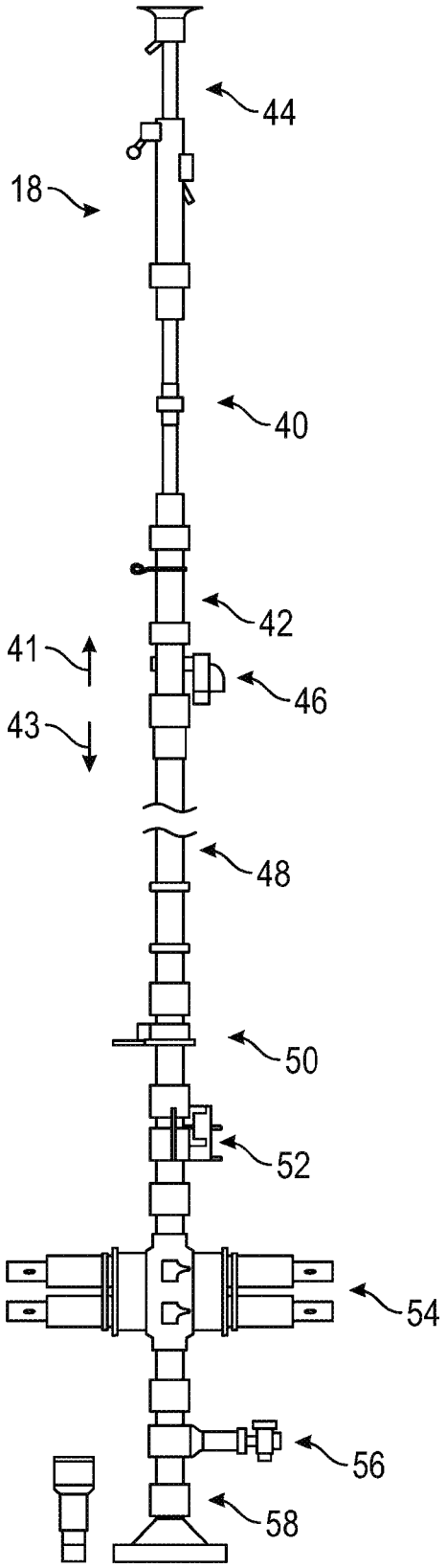
FIG. 3 shows an illustration of a wireline PCE stack for use in a wireline intervention operation, according to one or more embodiments of the present disclosure.

Referring now to FIG. 3, additional details of a wireline PCE stack 18, according to one or more embodiments of the present disclosure is shown. As shown in FIG. 3, the wireline PCE stack 18 may include various components, such as a packoff/line wiper 44, a grease head 40, the tool catcher system 42, a chemical injection sub 46, a lubricator 48, a quick test sub 50, a tool trap 52, a wireline valve, such as a hydraulic blowout preventer 54, a pump-in-sub/flow T 56, and an adapter flange/swedge 58, for connecting to a wellhead 12, as previously described, for example. The wireline PCE stack 18 according to one or more embodiments of the present disclosure may include all of the components shown in FIG. 3, some of the components shown in FIG. 3, or one or more other components that facilitate wireline intervention operations that are not shown in FIG. 3, for example. According to one or more embodiments of the present disclosure, as previously described with respect to FIG. 1, a tool 22 attached to an end of a cable 20 may be lowered via the cable 20 through the wireline PCE stack 18, through the wellhead 12, and into the wellbore 16. The lubricator 48, which is an assembly of conduits coupled together to form an axial passage, facilitates insertion of tools 22 into the wellbore 16. Thereafter, at least one wireline intervention operation may be performed in the wellbore 16 using the cable 20. Examples of wireline intervention operations include any operation carried out on an oil and gas well to extend its producing life by improving performance, provide data to help manage the production rate of the well, shut off and safely abandon a flowing well, provide maintenance, or repair or replace downhole equipment. After the wireline intervention operation is performed, the tool 22 may be withdrawn back into the lubricator 48 with the cable 20.

In order to block the unintended insertion of the tool 22 into the wellbore 16, the PCE stack 18 includes a tool catcher system 42, as previously described. The tool catcher system 42 selectively obstructs a bore in the lubricator 48 to block the movement of tools into the wellbore 16. For example, after performing a wireline intervention operation, the tool 22 is withdrawn back into the lubricator 48, where it latches to the tool catcher system 42. In view of FIG. 3, the tool catcher system 42 enables the tool 22 to travel in direction 41 (i.e., the upward direction), but blocks movement in direction 43 (i.e., the downward direction) unless specifically released. In this way, the tool catcher system 42 according to one or more embodiments of the present disclosure enables the retraction of tools from the wellbore 16 while also blocking the unintentional insertion of tools into the wellbore 16.

Figure 4:
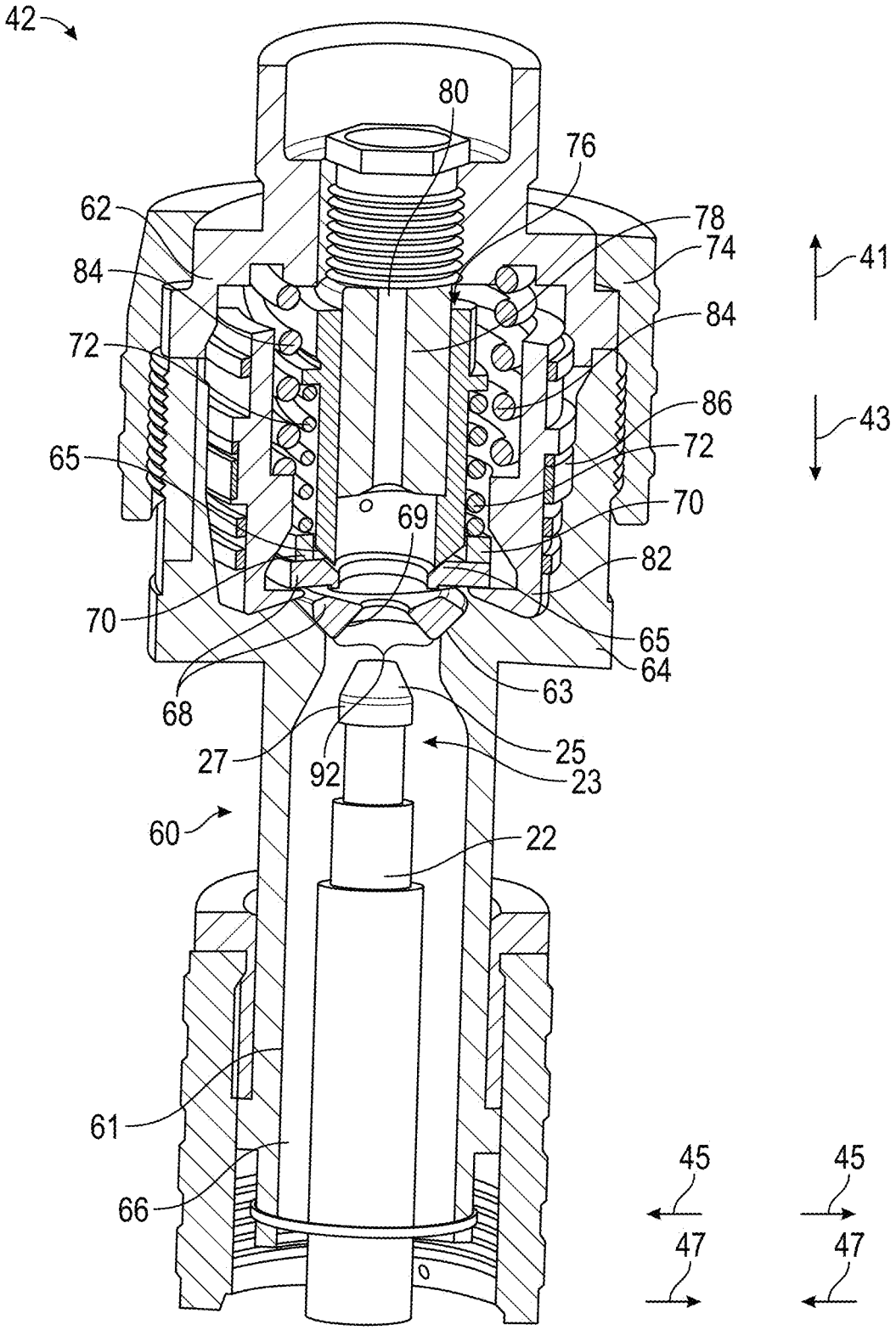
FIG. 4 shows a cross-sectional isometric view of a tool catcher system operable with a tool, according to one or more embodiments of the present disclosure.

Referring now to FIG. 4, a cross-sectional isometric view of a tool catcher system 42 operable with a tool 22 is shown according to one or more embodiments of the present disclosure. As shown in FIG. 4, the tool catcher system 42 includes a housing 60. According to one or more embodiments of the present disclosure, the housing 60 includes an upper body 62 connected to a lower body 64, and the housing 60 defines a central opening 66 that is configured to receive the tool 22. According to one or more embodiments of the present disclosure, the housing 60 also includes an interior surface 61 and a tapered surface 63 defined by the interior surface 61, as shown in FIG. 4, for example. As also shown in FIG. 4, the tool catcher system 42 may also include collar 74 disposed around the upper body 62 and the lower body 64 of the housing 60, according to one or more embodiments of the present disclosure.

Still referring to FIG. 4, the tool catcher system 42 according to one or more embodiments of the present disclosure also includes a plurality of segments 68 disposed between the upper body 62 and the lower body 64. As shown in FIG. 4, the plurality of segments 68 includes a plurality of angled surfaces 69, according to one or more embodiments of the present disclosure. As also shown in FIG. 4, the plurality of segments 68 abuts against a nose of the upper body 62, according to one or more embodiments of the present disclosure. In one or more embodiments, the plurality of segments 68 may assume, for example, a ring or cone shape for supporting the tool 22, as further described below. The tool catcher system 42 according to one or more embodiments of the present disclosure also includes a spring plate 70 that couples to and moves with the plurality of segments 68, and a first spring 72 that biases the spring plate 70 in direction 43 to catch the tool 22, as further described below.

Still referring to FIG. 4, the tool catcher system 42 according to one or more embodiments of the present disclosure also includes a mandrel 76 disposed in the upper body 62. According to one or more embodiments of the present disclosure, a resilient member 78, such as an elastomer, for example, extends around at least a portion of the mandrel 76. According to one or more embodiments of the present disclosure, the mandrel 76 defines a bore 80 that is configured to accommodate the cable 20 for supporting the tool 22 during wireline intervention operations, for example. As further described below, the plurality of segments 68 can be functioned to move in a radially outward direction to fully open. In this configuration, the mandrel 76 of the tool catcher system 42 may be removed to allow a tool 22 having a diameter up to about 1.75 inches, for example, to pass through the entire assembly. In this way, removal of the mandrel 76 saves significant rig up time for the field crew by avoiding the process of resealing the head of the tool 22.

Still referring to FIG. 4, the tool catcher system 42 according to one or more embodiments of the present disclosure includes a hydraulic piston 82 disposed between the upper body 62 and the lower body 64. As shown in FIG. 4, the hydraulic piston 82 is in direct engagement with the plurality of segments 68, according to one or more embodiments of the present disclosure. As further shown in FIG. 4, the tool catcher system 42 according to one or more embodiments of the present disclosure includes a second spring 84 abutting against the hydraulic piston 82. The tool catcher system 42 may also include a first wear band 86 disposed between the hydraulic piston 82 and the lower body 64, according to one or more embodiments of the present disclosure. Placing the first wear band 86 between the hydraulic piston 82 and the lower body 64 may improve the concentricity between the hydraulic piston 82 and the lower body 64 as the hydraulic piston 82 moves, and may improve galling resistance between these components by reducing metal-to-metal contact.

Figure 5:
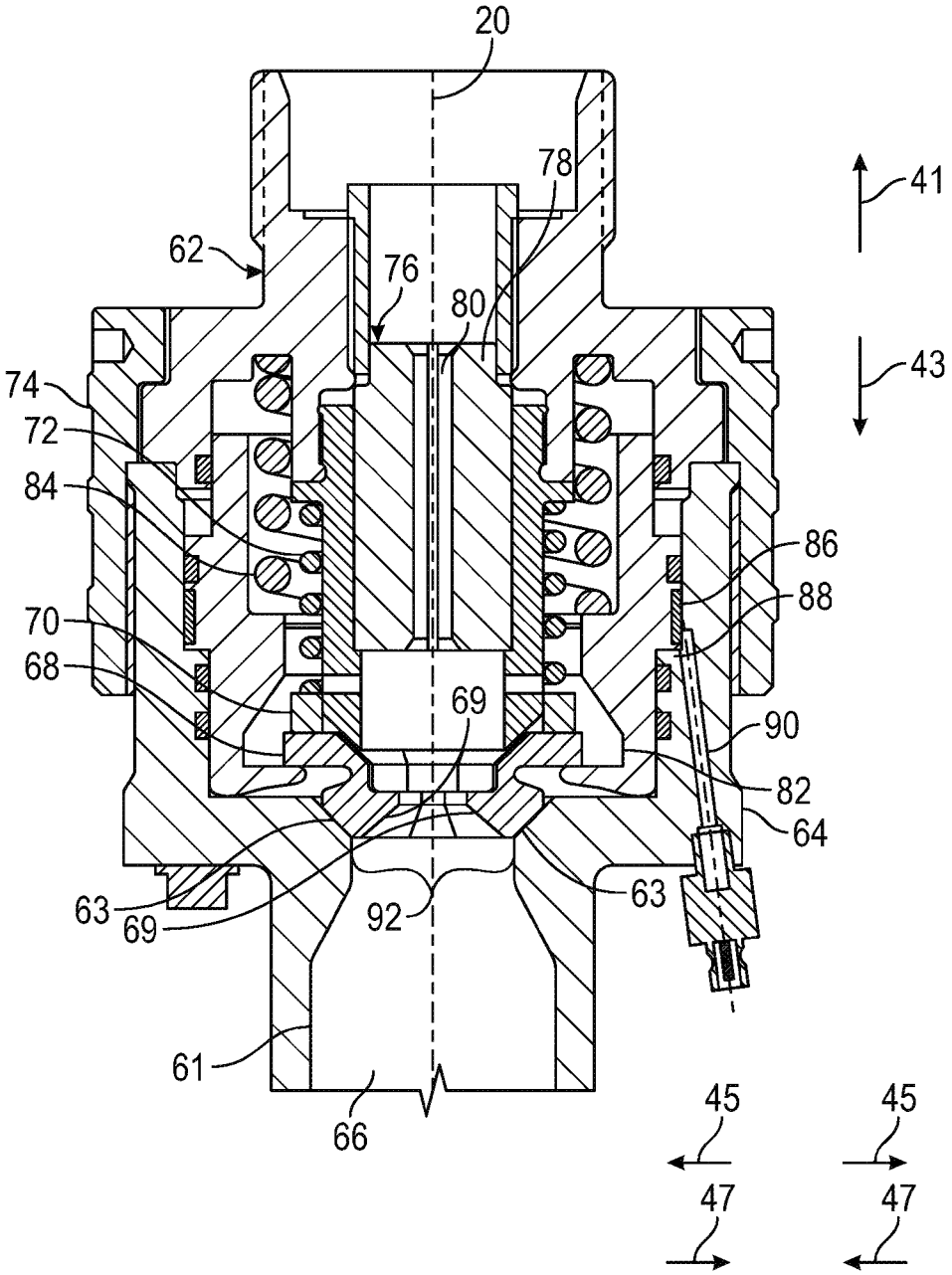
FIG. 5 shows a partial cross-sectional view of a tool catcher system, according to one or more embodiments of the present disclosure.

As more clearly shown in FIG. 5, the tool catcher system 42 according to one or more embodiments of the present disclosure also includes a piston chamber 88 and a hydraulic passage 90 that provides hydraulic fluid to the piston chamber 88 to actuate the hydraulic piston 82. Upon actuation, the hydraulic piston 82 is configured to move the plurality of segments 68 in direction 41, which pushes the spring plate 70 to move in direction 41 and compresses the second spring 84, thereby releasing the tool 22 from the tool catcher system 42, as further described below.

In operation, a deployed tool 22 may be pulled in direction 41 into the central opening 66 of the tool catcher system 42 using a cable 20, according to one or more embodiments of the present disclosure. As shown in FIG. 4, the tool 22 includes a tool head 23 having an angled surface 25 and a neck portion 27 beneath the angled surface 25. As the tool 22 is pulled in direction 41, the plurality of segments 68 will contact the tool head 23. As the pulling in direction 41 continues, the plurality of angled surfaces 69 of the plurality of segments 68 will engage the angled surface 25 of the tool head 23 creating a force that drives the plurality of segments 68 in a radially outward direction 45, and driving the spring plate 70 in direction 41, compressing the first spring 72. Advantageously, the plurality of segments 68 is able to open wide enough in the radially outward direction 45 to allow a tool head 23 having a diameter up to about 1.75 inches to pass through the assembly, which eases rig up operations at the well site. Indeed, the plurality of segments 68 of the tool catcher system 42 can accommodate a variety of tool head 23 diameters within the scope of the present disclosure. Once the angled surface 25 of the tool head 23 is pulled past the plurality of angled surfaces 69 of the plurality of segments 68, the first spring 72 drives the spring plate 70 in direction 43, thereby driving the plurality of segments 68 in a radially inward direction 47 into contact with the neck portion 27 of the tool head 23. Because the plurality of segments 68 latches onto the neck portion 27 of the tool head 23 in this way, the tool catcher system 42 according to one or more embodiments of the present disclosure is able to catch the tool 22 and prevent unintended movement of the tool in direction 43. The configuration in which the plurality of segments 68 latches onto the neck portion 27 of the tool head 23 catching the tool 22 is a closed position of the plurality of segments 68, according to one or more embodiments of the present disclosure.

In order to release the tool head 23, the hydraulic piston 82 is actuated, as previously described, which moves the hydraulic piston 82 in direction 41, compressing the second spring 84. In one or more embodiments of the present disclosure, actuating the hydraulic piston 82 lifts the plurality of segments 68 in direction 41, which pushes the spring plate 70 to move in direction 41, compressing the second spring 84. This action drives the plurality of segments 68 in the radially outward direction 45 to release the tool 22 from the tool catcher system 42. This configuration in which the plurality of segments 68 moves far enough in the radially outward direction 45 to release the tool 22 is an open position of the plurality of segments, according to one or more embodiments of the present disclosure.

Figure 7:
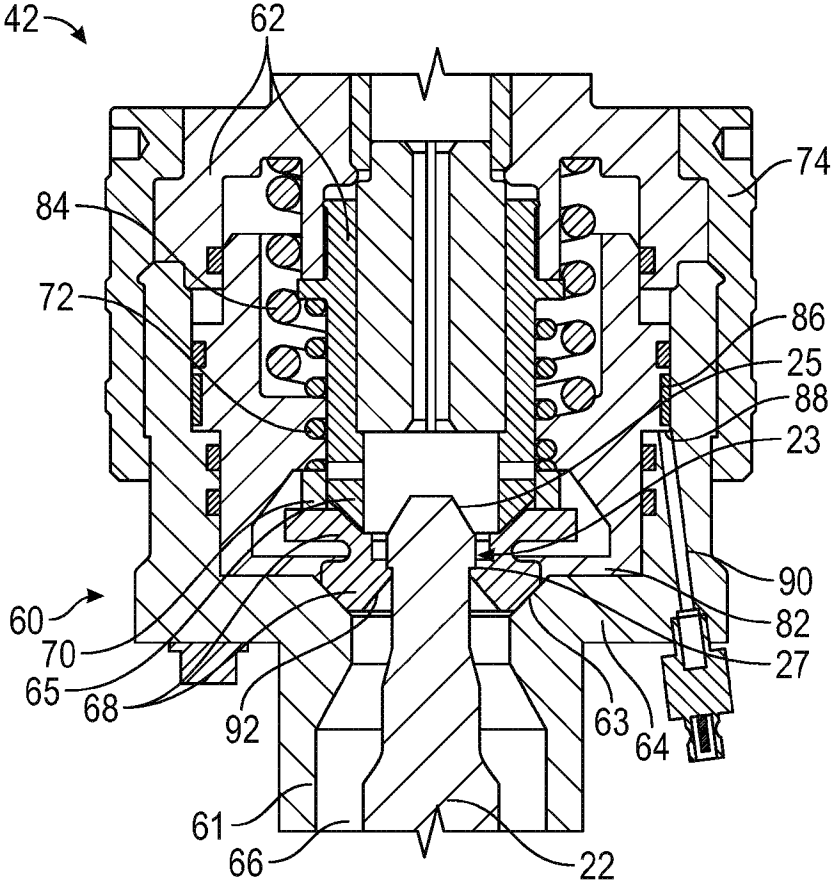
FIGS. 6-8 show sequencing of a tool being run through a tool catcher system, according to one or more embodiments of the present disclosure.
Figure 6:
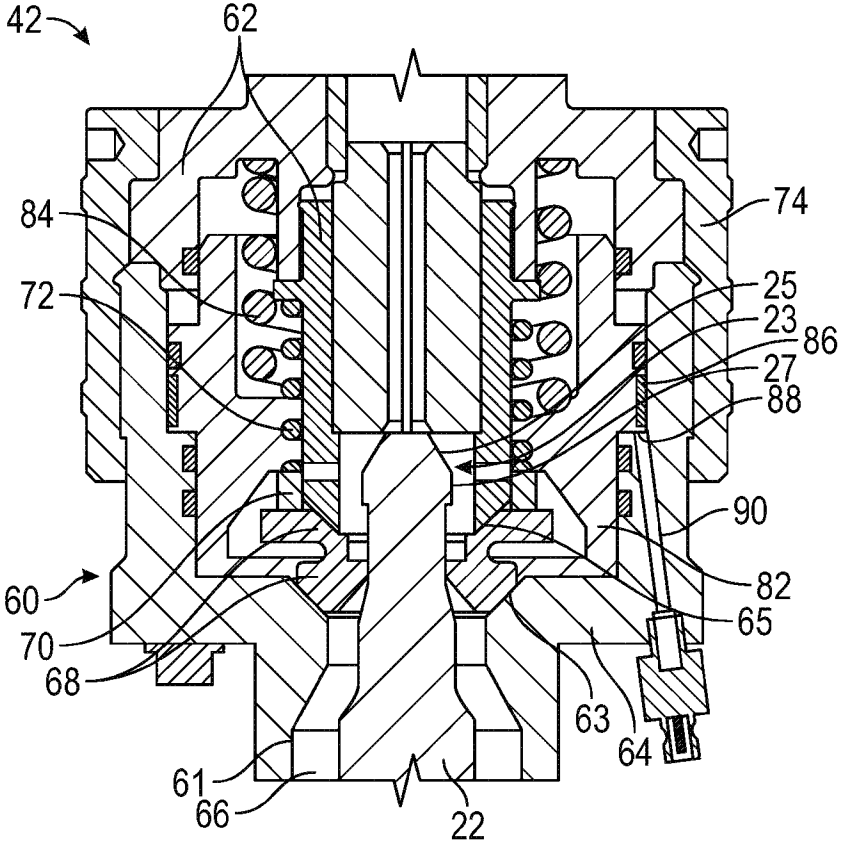
Figure 8:
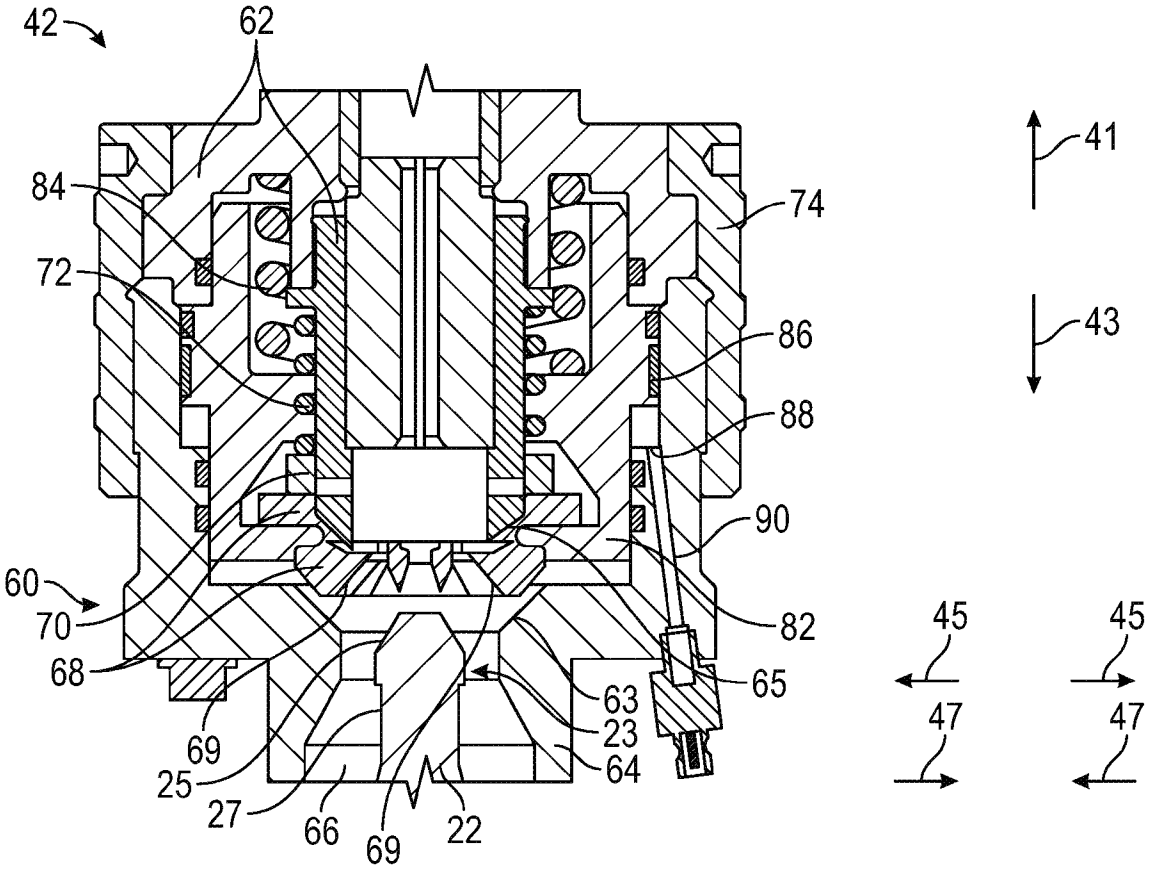

Referring now to FIGS. 6-8, sequencing of a tool 22 being run through a tool catcher system 42 according to one or more embodiments of the present disclosure is shown. Specifically, viewing these figures in sequence from FIG. 8 to FIG. 7 to FIG. 6 shows the method of pulling the tool 22 in upward direction 41 to catch the tool 22 with the plurality of segments 68 according to one or more embodiments of the present disclosure, as previously described. Further, viewing these figures in sequence from FIG. 6 to FIG. 7 to FIG. 8 shows the method of releasing the tool 22 from the plurality of segments 68 according to one or more embodiments of the present disclosure, as previously described. As shown, for example, FIGS. 6 and 7 show the plurality of segments 68 in a closed position for catching the tool 22, and FIG. 8 shows the plurality of segments 68 in an open position for releasing the tool 22.

Moreover, as shown in FIGS. 6 and 7, when the plurality of segments 68 is in a closed position (i.e., when the plurality of segments 68 contacts the neck portion 27 of the tool head 23), a surface of the plurality of segments 68 rests in contact with the tapered surface 63 defined by the interior surface 61 of the housing 60. As shown in FIG. 8, the plurality of segments 68 slides in direction 41 against the tapered surface 63 as the plurality of segments 68 moves from the closed position to the open position. As also shown in FIG. 8, the plurality of segments 68 contacts and slides along the nose 65 of the upper body 62 as the plurality of segments 68 moves from the closed position to the open position. Indeed, contacting and sliding along the nose 65 of the upper body 62 provides another way for the plurality of segments 68 to move in the radially outward direction 45, even if the plurality of segments 68 does not contact the lower body 64.

According to one or more embodiments of the present disclosure, the plurality of segments 68 defines an aperture 92 that is configured to receive the tool head 23 of the tool 22. According to one or more embodiments of the present disclosure, the aperture 92 through the plurality of segments 68 decreases as the plurality of segments 68 is driven in the radially inward direction 47, and the aperture 92 through the plurality of segments 68 increases as the plurality of segments 68 is driven in the radially outward direction 45. As previously described in view of FIG. 8, the plurality of segments 68 slides in direction 41 against the tapered surface 63, and slides along the nose 65 of the upper body 62, as the plurality of segments 68 moves from the closed position to the open position. Similarly, the plurality of segments 68 slides against the tapered surface 63 and slides along the nose 65 of the upper body 62 as the aperture 92 through the plurality of segments 68 changes size. Because the plurality of segments 68 slides against the tapered surface 63 and the nose 65 of the upper body 62 in this way, the plurality of segments 68 is prevented from pivoting, and the plurality of segments 68 maintains the same orientation as the plurality of segments 68 moves between the closed position and the open position, and as the aperture 92 changes size.

Figure 9:
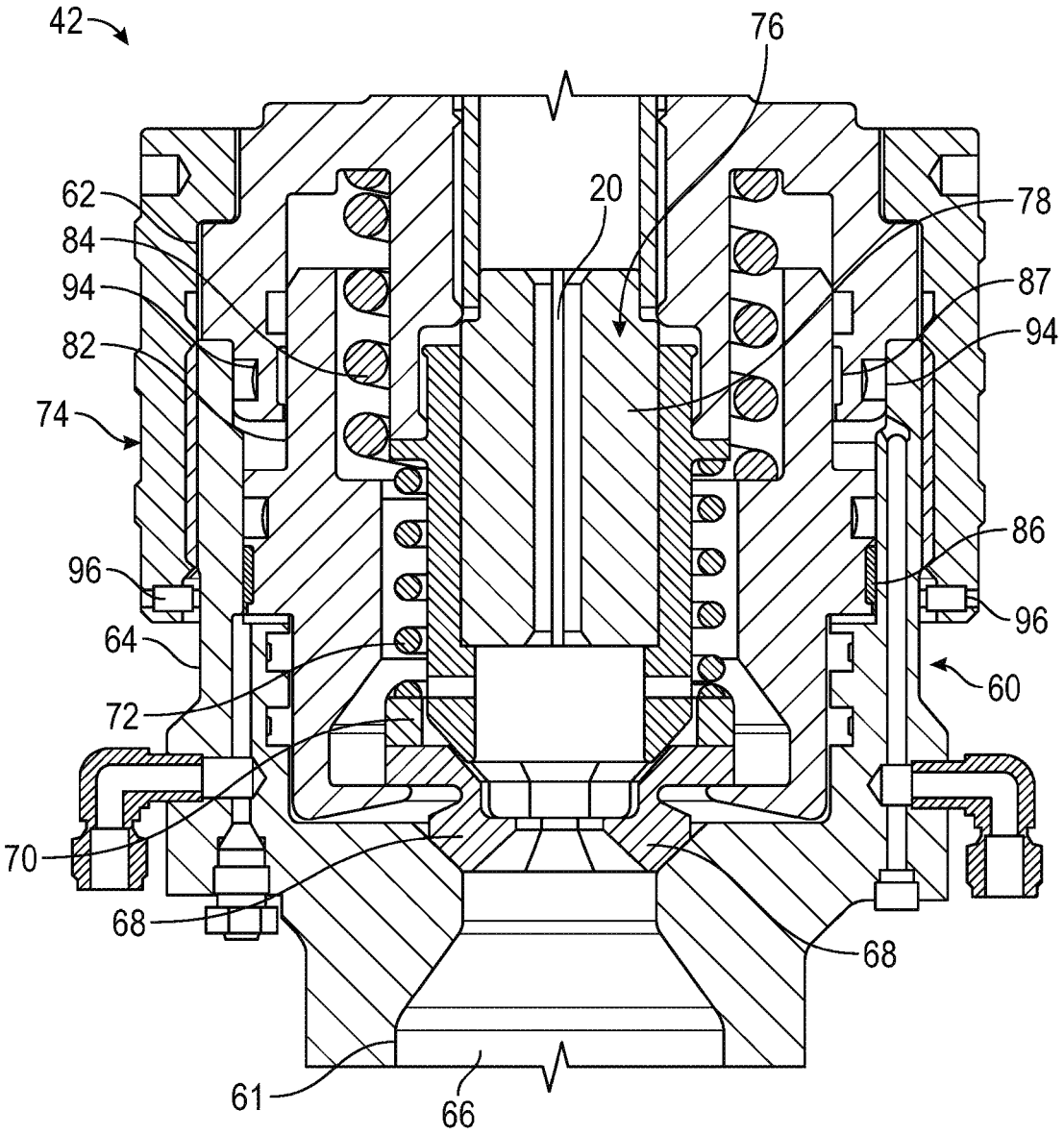
FIG. 9 shows a cross-sectional view of a subsea tool catcher system, according to one or more embodiments of the present disclosure.

Referring now to FIG. 9, a cross-sectional view of a tool catcher system 42 that may be used for subsea applications is shown, according to one or more embodiments of the present disclosure. As shown, the tool catcher system 42 shown in FIG. 9 includes components labeled with like reference numerals such as those previously described, the detailed description of which will not be repeated here. As further shown in FIG. 9, however, the tool catcher system 42 includes a seal 94 introduced between the upper body 62 and the lower body 64, which may allow the tool catcher system 42 to be used in subsea applications. According to one or more embodiments of the present disclosure, introducing the seal 94 into the tool catcher system 42 as described allows the hydraulic piston 82 to open and close the plurality of segments 68 by hydraulic pressure, and the second spring 84 shown may be eliminated. As also shown in FIG. 9, in addition to the first wear band 86, a second wear band 87 disposed between the hydraulic piston 82 and the upper body 62 may be added to the tool catcher system 42, according to one or more embodiments of the present disclosure. Placing the second wear band 87 between the hydraulic piston 82 and the upper body 62 may improve the concentricity between the hydraulic piston 82 and the upper body 62 as the hydraulic piston 82 moves, and may improve galling resistance between these components by reducing metal-to-metal contact. As further shown in FIG. 9, set screws 96 may be added on an end of the collar 74 of the tool catcher system 42 according to one or more embodiments of the present disclosure to avoid unintentional loosening of threaded components of the system during wireline intervention operations.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A tool catcher system, comprising:

a housing comprising an upper body connected to a lower body, wherein the housing defines a central opening that is configured to receive a tool, the upper body comprising a nose having a tapered surface;

a plurality of segments disposed between the upper body and the lower body, wherein the plurality of segments is configured to move between a closed position in which the plurality of segments catches the tool, and an open position in which the plurality of segments releases the tool, the plurality of segments abutting against the tapered surface of the nose of the upper body, such that the plurality of segments is prevented from pivoting as the plurality of segments moves between the closed position and the open position;

a spring plate coupled to and movable with the plurality of segments;

a hydraulic piston disposed between the upper body and the lower body, wherein the hydraulic piston engages the plurality of segments;

a first spring biasing the spring plate in a first direction to catch the tool;

a second spring abutting against the hydraulic piston; and a wear band disposed between the hydraulic piston and the lower body, the wear band configured to inhibit contact between the hydraulic piston and the lower body and maintain alignment between the hydraulic piston and the lower body as the hydraulic piston moves, wherein the hydraulic piston is configured to move the plurality of segments and compress the second spring in a second direction opposite the first direction to release the tool.

2. The tool catcher system of claim 1, wherein the lower body of the housing comprises: an interior surface; and a tapered surface defined by the interior surface, and wherein the plurality of segments contacts the tapered surface when the plurality of segments is in the closed position.

3. The tool catcher system of claim 2, wherein the plurality of segments slides in the second direction against the tapered surface as the plurality of segments moves from the closed position to the open position.

4. The tool catcher system of claim 1 further comprising:

a mandrel disposed in the upper body; and a resilient member extending around at least a portion of the mandrel, wherein the mandrel defines a bore that accommodates a cable for supporting the tool.

5. The tool catcher system of claim 4, further comprising an electronic controller coupled to an electronic actuator and operable to control the tool catcher system, wherein movement of the plurality of segments between the closed position and the open position occurs in a radially outward direction, and wherein movement of the plurality of segments creates an opening having a diameter of 1.75 inches, wherein the mandrel is removable from the tool catcher system.

6. A method, comprising:

pulling a tool in an upward direction into a central opening of a tool catcher system using a cable, the tool catcher system comprising:

a housing comprising an upper body connected to a lower body, wherein the housing defines the central opening for receipt of the tool, the upper body comprising a nose having a tapered surface;

a plurality of ring segments comprising a plurality of angled surfaces, the plurality of ring segments being disposed between the upper body and the lower body, the plurality of ring segments abutting against the tapered surface of the nose of the upper body, such that the plurality of ring segments is prevented from pivoting as the plurality of ring segments moves between a closed position and an open position;

a spring plate coupled to and movable with the plurality of ring segments;

a hydraulic piston disposed between the upper body and the lower body, wherein the hydraulic piston engages the plurality of ring segments;

a first spring biasing the spring plate in a downward direction to catch the tool; and a second spring abutting against the hydraulic piston, a wear band disposed between the hydraulic piston and the lower body, the wear band configured to inhibit contact between the hydraulic piston and the lower body and maintain alignment between the hydraulic piston and the lower body as the hydraulic piston moves;

wherein the tool comprises a tool head having an angled surface, and a neck portion beneath the angled surface;

contacting the plurality of ring segments with the tool head;

engaging the plurality of angled surfaces of the plurality of ring segments with the angled surface of the tool head, thereby driving the plurality of ring segments in a radially outward direction, and driving the spring plate in an upward direction, compressing the first spring;

pulling the angled surface of the tool head past the plurality of angled surfaces of the plurality of ring segments, causing the first spring to drive the spring plate in the downward direction, thereby driving the plurality of ring segments in a radially inward direction; and contacting the plurality of ring segments with the neck portion of the tool head, thereby catching the tool and preventing movement of the tool in the downward direction.

7. The method of claim 6, further comprising:

actuating the hydraulic piston to move the hydraulic piston in the upward direction, thereby lifting the plurality of ring segments and compressing the second spring;

moving the spring plate in the upward direction, thereby driving the plurality of ring segments in the radially outward direction; and releasing the tool from the tool catcher system.

8. The method of claim 7, wherein the plurality of ring segments defines an aperture that is configured to receive the tool head of the tool, wherein the aperture through the plurality of ring segments decreases as the plurality of ring segments is driven in the radially inward direction, wherein the aperture through the plurality of ring segments increases as the plurality of ring segments is driven in the radially outward direction, and wherein the plurality of ring segments maintains a same orientation as the aperture changes size.

9. The method of claim 8, wherein the lower body of the housing of the tool catcher system comprises: an interior surface; and a tapered surface defined by the interior surface, and wherein the plurality of ring segments slides against the tapered surface as the aperture through the plurality of ring segments changes size.

10. The method of claim 6, wherein the tool catcher system further comprises:

a mandrel disposed in the upper body; and a resilient member extending around at least a portion of the mandrel, wherein the mandrel defines a bore that accommodates the cable for supporting the tool.

11. The method of claim 6, wherein the lower body of the housing of the tool catcher system comprises: an interior surface; and a tapered surface defined by the interior surface, and wherein a surface of the plurality of ring segments rests in contact with the tapered surface when the plurality of ring segments contacts the neck portion of the tool head.

12. A tool catcher system, comprising:

a housing comprising an upper body connected to a lower body, wherein the housing defines a central opening that is configured to receive a tool, the upper body comprising a nose having a tapered surface;

a plurality of segments disposed between the upper body and the lower body, wherein the plurality of segments is configured to move between a closed position in which the plurality of segments catches the tool, and an open position in which the plurality of segments releases the tool, the plurality of segments abutting against the tapered surface of the nose of the upper body, such that the plurality of segments is prevented from pivoting as the plurality of segments moves between the closed position and the open position;

a spring plate coupled to and movable with the plurality of segments;

a hydraulic piston disposed between the upper body and the lower body, wherein the hydraulic piston engages the plurality of segments;

a spring biasing the spring plate in a first direction to catch the tool;

a seal disposed between the upper body and the lower body of the housing; and a wear band disposed between the hydraulic piston and the lower body, the wear band configured to inhibit contact between the hydraulic piston and the lower body and maintain alignment between the hydraulic piston and the lower body as the hydraulic piston moves, wherein the hydraulic piston is configured to move the plurality of segments, which pushes the spring plate in a second direction opposite the first direction to release the tool, and to move the spring plate in the first direction to catch the tool.

13. The tool catcher system of claim 12, wherein the lower body of the housing comprises: an interior surface; and a tapered surface defined by the interior surface, wherein the plurality of segments forms a cone, which rests in contact with the tapered surface when the plurality of segments is in the closed position, wherein the plurality of segments contacts and slides against the nose of the upper body as the plurality of segments moves from the closed position to the open position.

14. The tool catcher system of claim 13, wherein the plurality of segments slide in the second direction against the tapered surface as the plurality of segments move from the closed position to the open position, and wherein the plurality of segments slide in the first direction against the tapered surface as the plurality of segments move from the open position to the closed position.

15. The tool catcher system of claim 12, further comprising: a piston chamber; and a hydraulic passage that provides hydraulic fluid to the piston chamber to actuate the hydraulic piston.

16. The tool catcher system of claim 12, further comprising:

a mandrel disposed in the upper body; and a resilient member extending around at least a portion of the mandrel, wherein the mandrel defines a bore that accommodates a cable for supporting the tool.

17. The tool catcher system of claim 12, further comprising a collar disposed around the upper body and the lower body.

* * * * *